United States Patent [19]

Makita

[11] Patent Number: 5,034,771

[45] Date of Patent: Jul. 23, 1991

[54] COPIER HAVING SUPERIMPOSED AND DUPLEX COPYING CAPABILITIES AND CAPABLE OF DISCRIMINATING FALSE PAPER JAM AND REAL PAPER JAM

[75] Inventor: Kastsuhiko Makita, Tokyo, Japan

[73] Assignee: Ricoh Company, Ltd., Japan

[21] Appl. No.: 452,761

[22] Filed: Dec. 19, 1989

[30] Foreign Application Priority Data

Dec. 28, 1988 [JP] Japan ..... 63-331022

[51] Int. Cl.[5] ..... G03G 21/00

[52] U.S. Cl. ..... 355/204; 271/3; 271/902; 355/206; 355/316

[58] Field of Search ..... 355/206, 207, 204, 318, 355/244, 316, 319, 308, 205; 271/3, 3.1, 225, 258, 265, 186, 962

[56] References Cited

U.S. PATENT DOCUMENTS 4,176,941 12/1979 Breitenkam et al. ..... 355/206
4,787,616 11/1988 Sasaki et al. ..... 271/3.1
4,812,877 3/1989 Nishimori et al. ..... 355/244
4,831,411 5/1989 Sugishima ..... 355/319
4,878,087 10/1989 Sakai et al. ..... 355/207
4,928,150 5/1990 Hatta ..... 355/319 X

FOREIGN PATENT DOCUMENTS 0114254 5/1986 Japan ..... 355/319

*Primary Examiner*—A. T. Grimley
*Assistant Examiner*—William J. Royer
*Attorney, Agent, or Firm*—Mason, Fenwick & Lawrence

[57] ABSTRACT

A copier having superimposed copying and duplex copying capabilites and free from malfunctions ascribable to false jam detection which is caused by sensor errors. When a paper jam is detected due to the failure of a sensor, the copier determines whether or not a jamming paper sheet actually exists instead of immediately determining that a jam has occurred. If no jamming paper sheet exists, the copier does not perform any paper discharging movement by determining that the detection is caused by a sensor error and disables the superimposed copying and duplex copying functions.

5 Claims, 4 Drawing Sheets

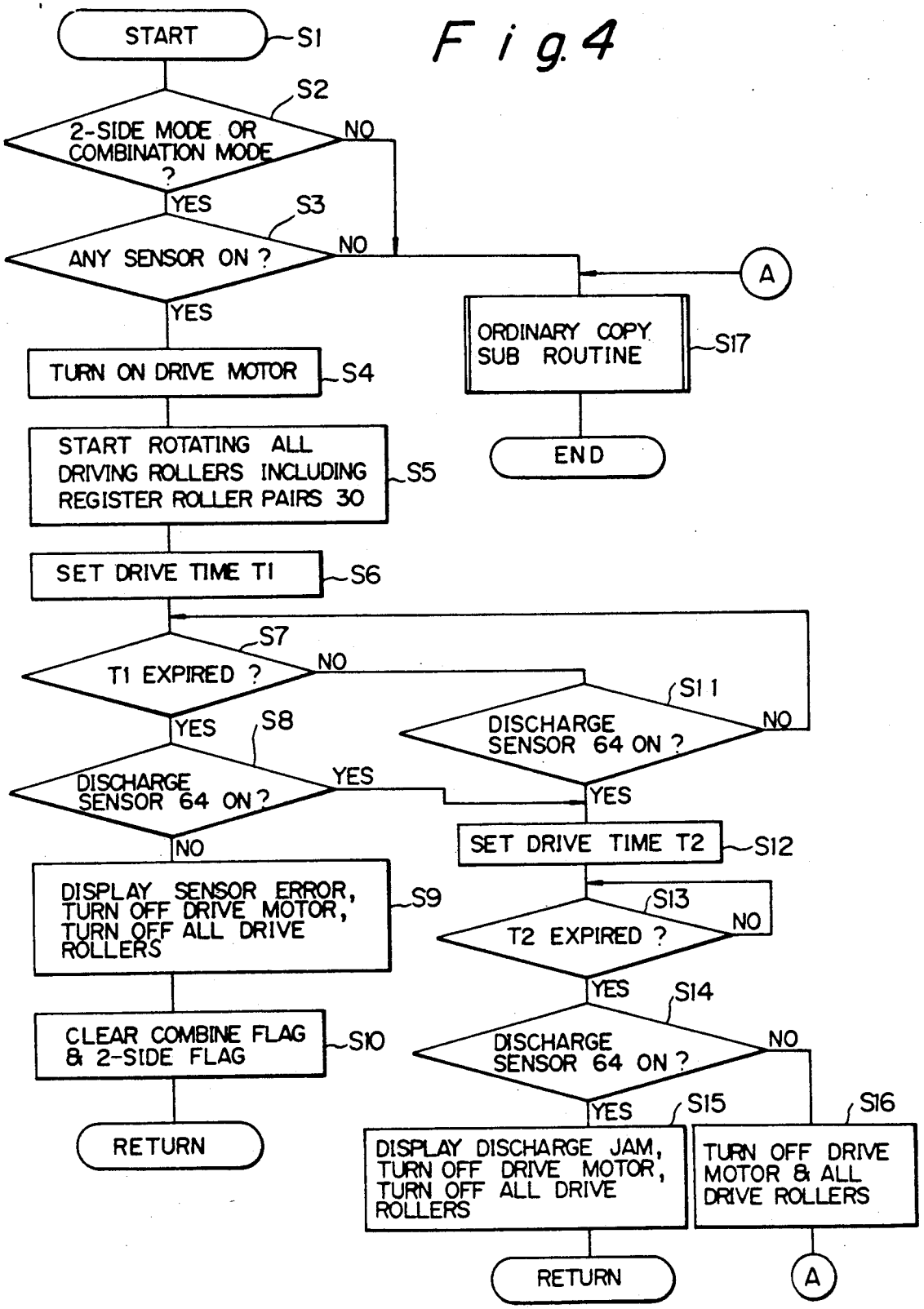
Fig.4
START
S1
S2
2-SIDE MODE OR COMBINATION MODE ?
NO
YES
S3
ANY SENSOR ON ?
NO
YES
A
ORDINARY COPY SUB ROUTINE
S17
END
TURN ON DRIVE MOTOR
S4
START ROTATING ALL DRIVING ROLLERS INCLUDING REGISTER ROLLER PAIRS 30
S5
SET DRIVE TIME T1
S6
S7
T1 EXPIRED ?
NO
YES
S8
DISCHARGE SENSOR 64 ON ?
YES
NO
S11
DISCHARGE SENSOR 64 ON ?
NO
YES
SET DRIVE TIME T2
S12
DISPLAY SENSOR ERROR, TURN OFF DRIVE MOTOR, TURN OFF ALL DRIVE ROLLERS
S9
S13
T2 EXPIRED ?
NO
YES
S14
DISCHARGE SENSOR 64 ON ?
NO
YES
CLEAR COMBINE FLAG & 2-SIDE FLAG
S10
RETURN
S15
DISPLAY DISCHARGE JAM, TURN OFF DRIVE MOTOR, TURN OFF ALL DRIVE ROLLERS
S16
TURN OFF DRIVE MOTOR & ALL DRIVE ROLLERS
RETURN
A

COPIER HAVING SUPERIMPOSED AND DUPLEX COPYING CAPABILITIES AND CAPABLE OF DISCRIMINATING FALSE PAPER JAM AND REAL PAPER JAM

BACKGROUND OF THE INVENTION

The present invention relates to an image forming apparatus having a combination or superimposed copying capability and a two-side or duplex copying capability and, more particularly, to a copier operable in a superimposed copy mode and a duplex copy mode and free from malfunctions ascribable to the failure of a sensor which is responsive to a paper jam.

Many of modern copiers are selectively operable in a combination or superimposed copy mode for reproducing information printed on a plurality of documents on one side of a single paper sheet, and a or duplex mode for reproducing them on opposite sides of a single paper sheet. A copier of this type has an exclusive paper transport path for implementing the superimposed and/or duplex copy mode in addition to a paper transport path for an ordinary one-side mode. The exclusive path branches off the ordinary path at a position between a discharge roller and a fixing device. The exclusive path extends to a register roller so as to refeed a paper sheet carrying an image on one side thereof, or one-sided paper sheet, to a photoconductive drum.

Regarding a paper transport mechanism, a copier with such superimposed copying and duplex copying capabilities is far more complicated and, therefore, needs more sensors responsive to the position of a paper sheet than an ordinary copier having a one-side copying capability only. The intricacy of paper transport mechanism directly translates into an increase in the frequency of paper jam, while an increase in the number of sensors results in an increase in the probability of their failure and, therefore, in false paper detection. For example, despite that no jam has occurred on the paper transport path, i.e., no paper sheet is present in the paper transport route, a sensor may determine that a paper sheet is present and may thereby interrupt the operation of the copier while displaying a jam on the copier. Then, one has to search for a jamming paper sheet which does not exist by opening the door of the copier. This not only wastes time and labor but also makes one distrustful of the copier.

SUMMARY OF THE INVENTION

It is therefore an object of the present invention to provide a copier operable in a superimposed copy mode and a duplex copy mode which discriminates a false paper jam ascribable to a sensor error and a real paper jam and executes adequate processing.

It is another object of the present invention to provide a generally improved copier having superimposed copying and duplex copying capabilities.

A copier is operable in a superimposed copy mode for reproducing a plurality of document information on one side of a paper sheet, a duplex copy mode for reproducing document information on opposite sides of a single paper sheet, and a one-side copy mode. In accordance with the present invention, there are provided a paper transport path for transporting the paper sheet during either one of the superimposed copy mode operation and a duplex copy mode operation, and a paper transporting device along the paper transport path for transporting the paper sheet. There are further provided paper transport sensors arranged at a plurality of locations on the paper transport path for sensing a state of transport of the paper sheet, and a paper discharge sensor located in a discharge position where the paper sheet is to be discharged. Also, a superimposed copy mode key and a duplex copy mode key are accessible for selecting the superimposed copy mode and the duplex copy mode respectively.

A controller is provided for controlling the paper transporting device, the superimposed copy mode key and the duplex copy mode key in response to detection of the paper sheet by the paper transport sensor and detection of the paper sheet by the paper discharge sensor. The controller is operable such that when the paper transport sensor has sensed presence of the paper sheet on the paper transport path after start of a superimposed copy mode operation or a duplex copy mode operation, the mode operation is interrupted and the paper transporting device is driven for a first predetermined period of time in order to discharge the paper sheet from the paper transport path. If the first predetermined period of time expires before the paper discharge sensor senses the paper sheet, it is decided that an error has occurred on the paper transport path. Operation of the superimposed copy mode key and the duplex copy mode key are inhibited but the ordinary one-side copy mode operation may still be performed.

BRIEF DESCRIPTION OF THE DRAWINGS

The above and other objects, features and advantages of the present invention will become more apparent from the following detailed description taken with the accompanying drawings in which:

FIG. 4 is a flowchart demonstrating a specific operation of the control system shown in FIG. 2.

DESCRIPTION OF THE PREFERRED EMBODIMENT

Figure 1:
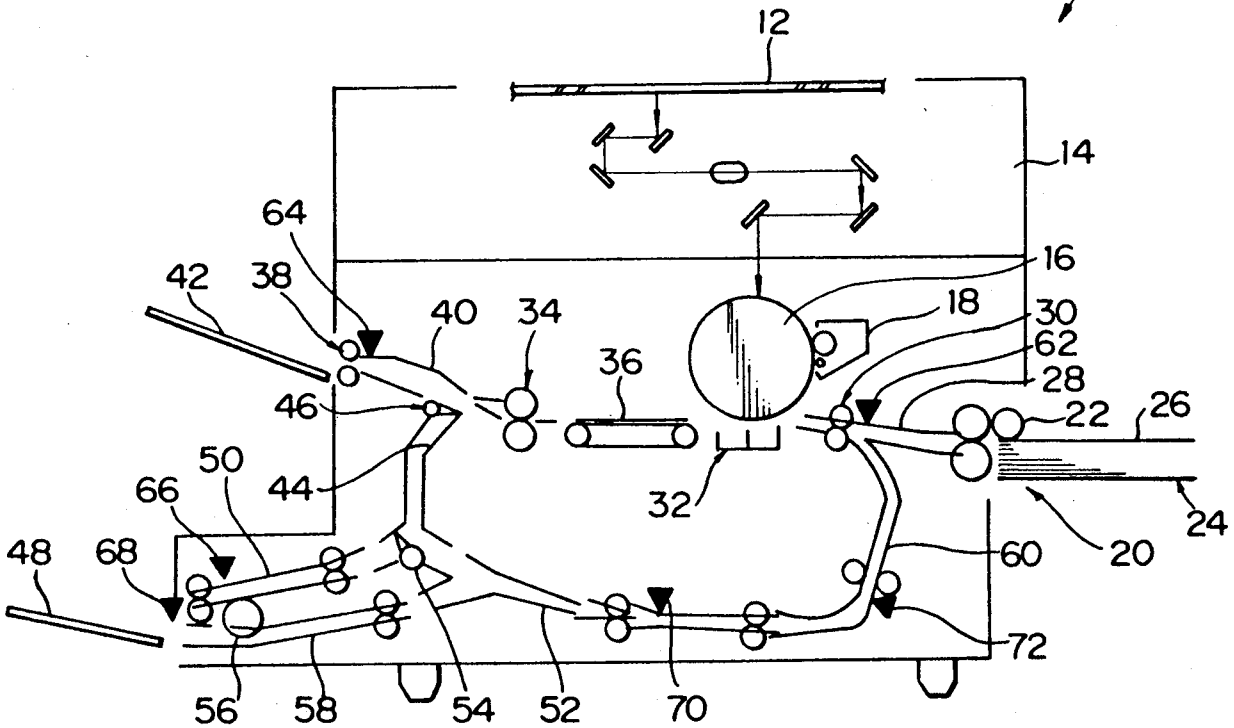
FIG. 1 is a side elevation schematically showing a copier embodying the present invention and belonging to a family of image forming apparatuses to which the present invention is applicable.

Referring to FIG. 1 of the drawings, a copier embodying the present invention is shown and generally designated by the reference numeral 10. As shown, the copier 10 has a glass platen 12 to be loaded with a document, and optics in the form of a scanner 14 for optically scanning the document on the glass platen 12. A photoconductive drum 16 is exposed imagewise to form a latent image representative of the document thereon. A developing device 18 develops the latent image on the drum 16 to by using a toner. A paper feeding device 20 has a feed roller 22 and a paper cassette 24 which is loaded with a stack of paper sheets 26. A paper sheet 26 fed by the feed roller 22 out of the cassette 24 is driven to the drum 16 by a guide 28 and a register roller pair 30. An image transferring device 32 transfers the toner image from the drum 16 to the paper sheet 26. A transport belt 36 transports the paper sheet carrying the toner image thereon, or one-sided paper sheet, to a fixing device 34. A discharge guide plate 40 steers the one-sided paper sheet 26 coming out of the fixing device 34 toward a discharge roller pair 38. A copy tray 42 is located next to the discharge roller pair 38. A refeed guide 44 guides the one-side paper sheet 26 during a duplex or superimposed copy mode operation. A refeed selector in the form of a pawl 46 is located at a position where the discharge guide 40 and the retransport guide 44 adjoin each other, and it is rotatable to steer the paper sheet 26 toward either one of the guides 40 and 44. A two-side or duplex guide 50 is located downstream of the refeed guide 44 in order to guide the paper sheet 26 toward a two-side or duplex tray 48. A combination guide 52 guides the paper sheet 26 directly toward the register roller pair 30 from the guide 44. A selector in the form of a pawl 54 is also located at a position where the two guides 50 and 52 adjoin each other and is rotatable to steer the paper sheet 26 toward either one of the guides 50 and 52. A feed roller 56 and a two-side or duplex guide 58 cooperate to send the one-sided paper sheet 26 from the duplex tray 48 to the combination guide 52 while turning it over. A guide 60 retransports the paper sheet 26 coming in from the refeed guide 44 or the duplex guide 58 to the register roller pair 30.

Various sensors are disposed on the transport paths of the copier 10 for sensing the presence of the paper sheet 26. Specifically, a register sensor 62 is located upstream of the register roller pair 30 with respect to the direction of paper transport. A paper discharge sensor 64 is located upstream of the discharge roller pair 38. A release sensor 66 is disposed on the duplex guide 50. A paper end sensor 68 is interposed between the duplex tray 48 and the feed roller 56 associated therewith. Further, transport sensors 70 and 72 are associated with the guide 60.

In an ordinary one-side copy mode, the paper sheet 26 fed out from the paper cassette 24 is driven by the discharge roller pair 38 directly onto the copy tray 42. In a superimposed mode, the paper sheet 26 is driven from the register roller pair 30 back to the register roller pair 30 by way of the selector 46, superimposed guide 52, and guide 60. After image transfer and fixation, the paper sheet is driven out of the copier 10 onto the copy tray 42 by the discharge roller pair 38. In a duplex copy mode, the paper sheet 26 is routed from the refeed guide 44 to the superimposed guide 52 by way of the duplex guide 50, duplex tray 48, and duplex guide 58 and then transported to the register roller pair 30.

Figure 2:
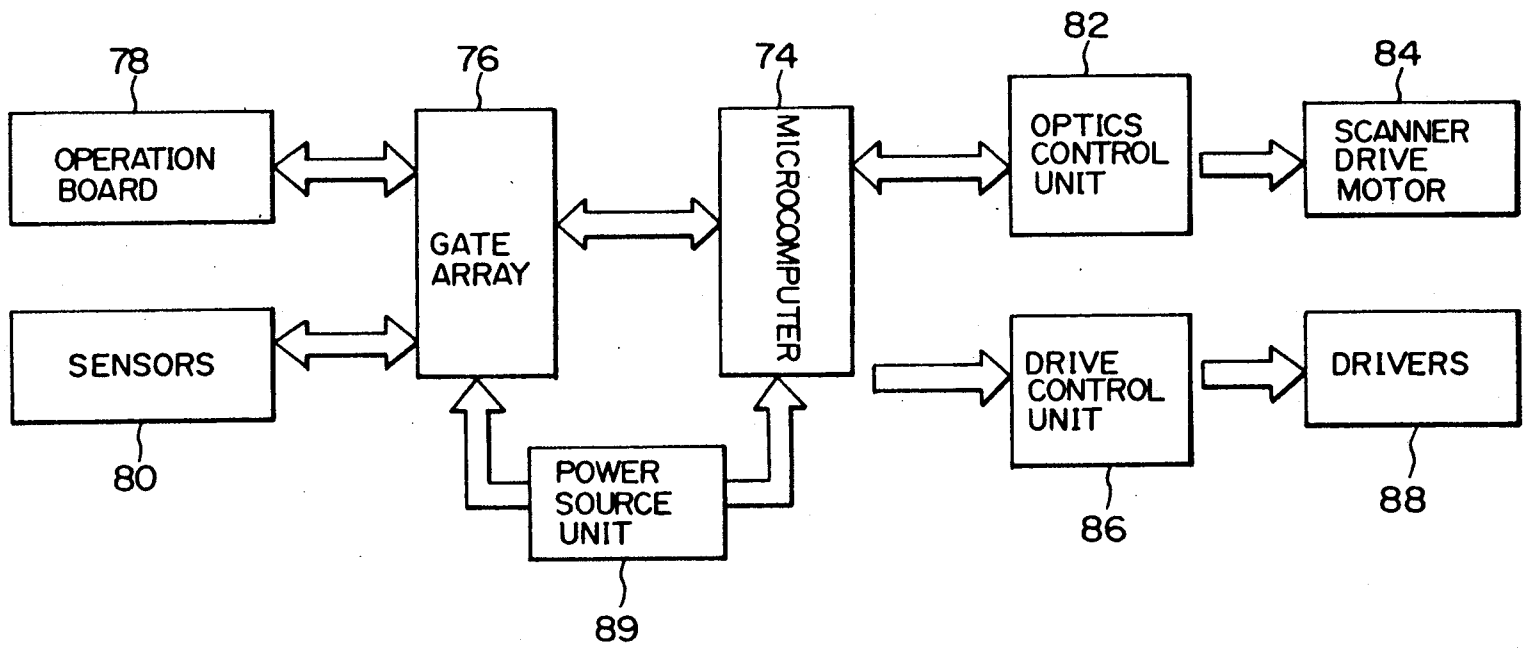
FIG. 2 is a schematic block diagram of a control system installed in the copier shown in FIG. 1.

Referring to FIG. 2, a control system installed in the copier 10 includes a microcomputer 74 having a CPU (Central Processing Unit), memories, etc. The microcomputer 74 is interconnected to an operation board 78 and various sensors 80 via a gate array 76 to receive commands and sensor outputs from the latter. In response to such signals, the CPU of the microcomputer 74 reads associated control data out of a ROM, for example, and controls various units such as an optics control unit 82 and a drive control unit 86. The optics control unit 82 controllably drives a scanner drive motor 84, while the drive control unit 86 controls various drivers, not shown. The reference numeral 89 designates a power source unit.

Figure 3:
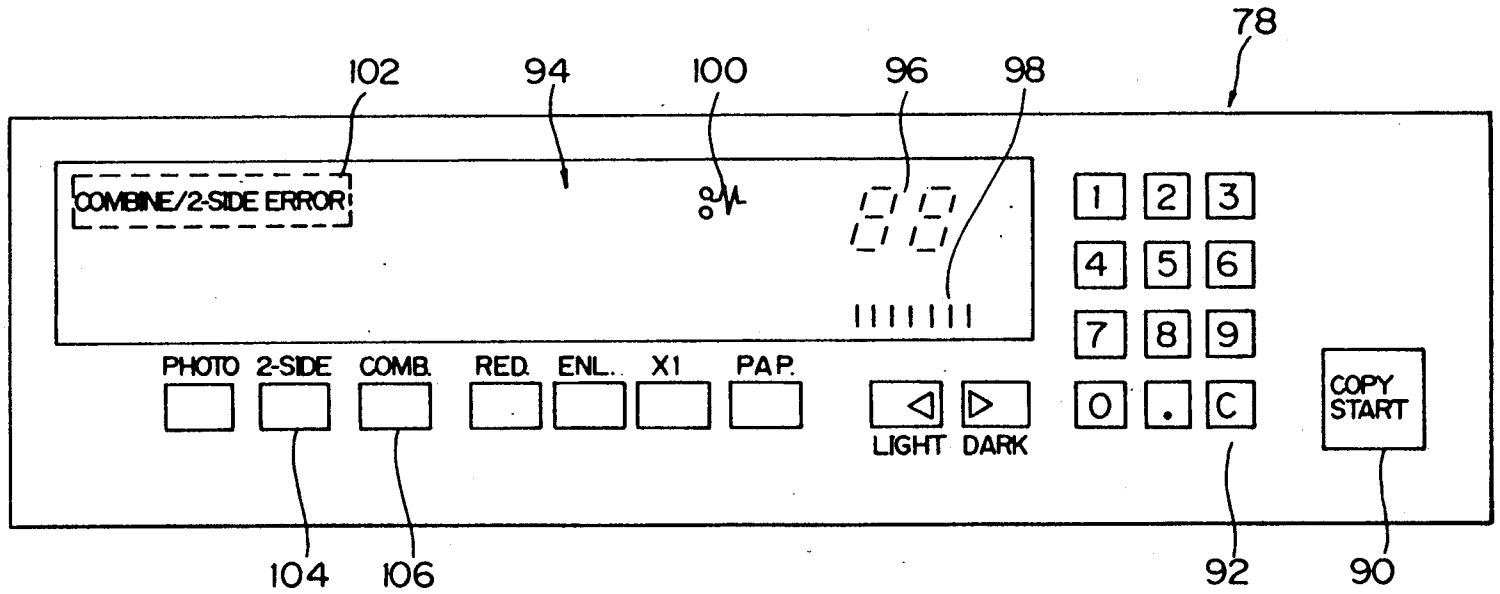
FIG. 3 is a view showing an operation board provided on the copier of FIG. 1.

FIG. 3 shows a specific construction of the operation board or console 78 which is provided on the copier 10. As shown, the operation board 78 has a copy start key 90, numeral keys 92, and a display 94. The display 94 includes a copy number display section 96, a density display section 98, a jam display section 100, and a guidance display section 102 for informing the operator of an error. Various keys such as a key 104 for selecting a duplex copy mode and a key 106 for selecting a combination copy mode are also arranged on the operation board 78.

In the illustrative embodiment, immediately after the turn-on of the copy start key 90, the control system checks the outputs of the various sensors. If any one of the sensors produces an output representative of the presence of a paper sheet, the system activates the transport mechanisms arranged on all of the paper transport paths and thereby causes them to perform paper discharging movements for a predetermined period of time. If the discharge sensor 64 (or the release sensor 66) does not produce a paper discharge signal on the lapse of the predetermined period of time, the system disables the superimposed copying function and duplex copying function by determining that the sensors have failed. Nevertheless, the copier 10 is still operable in an ordinary copy mode and, therefore, with a minimum of down time.

Referring to FIG. 4, a specific operation of the control system shown in FIG. 2 will be described. When the copy start key 90 is turned on to start a copying procedure (step S1), whether or not either one of the two-side and superimposed copy modes has been selected is determined (step S2). If the answer of the step S2 is YES, a step S3 is executed for determining whether or not any one of the sensors, especially the release sensor 66, duplex paper end sensor 68 and combination and duplex sensors 70 and 72, is in an ON state. If the answer of the step S3 is YES, meaning that a jamming paper sheet is present, the program advances to step S4 for energizing a drive motor adapted to transport a paper sheet. If the answer of the step S3 is No, the system displays the absence of error on the operation board 78 by determining that the paper transport paths are free from errors. When the motor is energized in the step S4, all the drive rollers such as the register roller pair 30 begin to rotate (step S5) while a predetermined drive time T1 is set (step S6). Then, whether or not the period of time T1 has expired is determined (step S7). If the answer of the step S7 is YES, the system checks the discharge sensor 64 to see if its output has turned to an ON state (step S8). If the answer of the step S8 is NO, meaning that a paper sheet 26 which should have existed at a certain location does not reach the sensor 64 or 66, the system determines that the sensor is faulty. Then, in a step S9, the sensor error is displayed, the motor is deenergized, and all the drive rollers are deactivated. The step S9 is followed by a step S10 for clearing a superimposed flag and a duplex flag to thereby render the superimposed key 106 and two-side key 104 unoperable. Concerning the software, a (logical) ONE is assigned to each of the keys provided on the operation boar 78 and is replaced with a (logical) ZERO only when an error occurs. More specifically, a ONE accepts a key input while a ZERO rejects it.

If the answer of the step S7 is No, i.e., if the discharge sensor 64 is turned to an ON state before the drive time T1 expires (step S11), or if the discharge sensor 64 is done so on the lapse of the drive time T1 as determined by the step S8, the system determines that a paper sheet having jammed the transport path is now positioned at the discharge sensor 64. Then, a step S12 is executed for setting another predetermined period of time T2 and activating all the driving mechanisms for the period of time T2 in order to discharge the paper sheet to the copy tray 42. Whether or not the drive time T2 has expired is determined in a step S13. If the answer of the step S13 is YES, whether or not the discharge sensor 64 is in an ON state is determined (step S14). If the answer of the step S14 is YES, meaning that the paper sheet 26 is still located at the discharge sensor 64 jamming the path, a step S15 is executed to display a discharge jam, deenergize the drive motor, and deactivate all the driving rollers. If the answer of the step S14 is NO, the paper sheet 26 will have been discharged from the discharge sensor 64 to the copy tray 42. Hence, in step S16, the drive motor is deenergized while all the driving rollers are deactivated. Subsequently, the program returns to an ordinary copy subroutine. (step S17).

By the above-described sequence of steps, it is possible to eliminate the waste of time and labor ascribable to false detection of a paper jam due to a sensor error.

In summary, in accordance with the present invention, a copier or similar image forming apparatus having superimposed copying and duplex copying capabilities is constructed such that when a sensor senses a paper jam, the apparatus determines whether or not a jamming paper sheet actually exists instead of immediately concluding that a jam has occured. If such a paper sheet does not exist, the apparatus does not perform any paper discharging movement by determining that the sensor is faulty and disables the superimposed and duplex copying functions.

Various modifications will become possible for those skilled in the art after receiving the teachings of the present disclosure without departing from the scope thereof.

What is claimed is:

1. A copier operable in modes including (i) a superimposed copy mode for reproducing information from a plurality of documents onto one side of a paper sheet, (ii) a duplex copy mode for reproducing document information on opposite sides of a single paper sheet, and (iii) a one-side copy mode, the copier comprising:

a) a paper transport path for transporting the paper sheet in either the superimposed copy mode or the duplex copy mode;

b) paper transporting means provided along the paper transport path, for transporting the paper sheet;

c) paper transport sensor means arranged at a plurality of locations along the paper transport path, for sensing a state of transport of the paper sheet;

d) paper discharge sensor means located at a discharge position where the paper sheet is to be discharged, for sensing discharge of the paper sheet;

e) a superimposed copy mode key and a duplex mode copy key, accessible for selecting the superimposed copy mode and the duplex copy mode, respectively; and f) control means for controlling the paper transporting means, the superimposed copy mode key and the duplex copy mode key, in response to detection of the paper sheet by the paper transport sensor means and detection of the paper sheet by the paper discharge sensor means, wherein:

1) when the paper transport sensor means has sensed presence of the paper sheet on the paper transport path after the start of a superimposed copy mode operation or a duplex copy mode operation, the mode operation is interrupted and the paper transporting means is driven for a first predetermined period of time in order to discharge the paper sheet from the paper transport path; and 2) when the first predetermined period of time expires before the paper discharge sensor means senses the paper sheet, a decision is made that an error has occurred on the paper transport path and operation of the superimposed copy mode key and the duplex copy mode key are inhibited but one-side copy mode operation may still be performed 2. The copier of claim 1, wherein the control means further controls the paper transporting means so that:

when the discharge sensor means has sensed presence of the paper sheet on the discharge position before the first predetermined period of time expires, the paper transporting means is driven for a second predetermined period of time in order to discharge the paper sheet from the discharge position; and when the dishcharge sensor has sensed presence of the paper sheet at the discharge position after the second predetermined period of time expires, a decision is made that an error has occurred at the discharge position and operation of the paper transporting means is inhibited, but one-side copy mode operation may still be performed.

3. The copier of claim 2, wherein the control means further controls the paper transporting means so that:

when the discharge sensor means has not sensed presence of the paper sheet at the discharge position after the second predetermined period of time expires, a decision is made that the paper sheet has been discharged from the discharge position, and operation of the paper transporting means is inhibited, and one-side copy mode operation may be performed.

4. The copier of claim 3, further comprising:

display means for displaying the error occurring on the paper transport path or on the discharge position.

5. The copier of claim 4, wherein:

the error comprises a paper sheet jam.

* * * * *